US010962017B2

(12) United States Patent
Tsukamoto et al.

(10) Patent No.: US 10,962,017 B2
(45) Date of Patent: Mar. 30, 2021

(54) CENTRIFUGAL FAN

(71) Applicant: Nidec Corporation, Kyoto (JP)

(72) Inventors: Tomoyuki Tsukamoto, Kyoto (JP); Kazuhiko Fukushima, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 122 days.

(21) Appl. No.: 16/267,563

(22) Filed: Feb. 5, 2019

(65) Prior Publication Data

US 2019/0264694 A1 Aug. 29, 2019

(30) Foreign Application Priority Data

Feb. 26, 2018 (JP) ..... JP2018-031906

(51) Int. Cl.

| | |
|---|---|
| ***F04D 17/16*** | (2006.01) |
| ***F04D 25/06*** | (2006.01) |
| ***F04D 29/28*** | (2006.01) |
| ***F04D 29/66*** | (2006.01) |
| ***F04D 29/42*** | (2006.01) |
| ***F04D 29/62*** | (2006.01) |

(52) U.S. Cl.

CPC ..... *F04D 17/16* (2013.01); *F04D 25/0606* (2013.01); *F04D 29/281* (2013.01); *F04D 29/288* (2013.01); *F04D 29/4226* (2013.01); *F04D 29/624* (2013.01); *F04D 29/666* (2013.01); *F05B 2230/232* (2013.01); *F05B 2240/14* (2013.01); *F05B 2240/301* (2013.01); *F05B 2260/96* (2013.01); *F05B 2280/6012* (2013.01)

(58) Field of Classification Search

CPC ..... F04D 29/288; F05B 2280/6012

See application file for complete search history.

(56) References Cited

U.S. PATENT DOCUMENTS

| | | | | |
|---|---|---|---|---|
| 3,128,940 | A * | 4/1964 | McDonald | F04D 17/167 416/185 |
| 5,427,503 | A | 6/1995 | Haraga et al. | |
| 5,707,205 | A | 1/1998 | Otsuka | |
| 2003/0000684 | A1 | 1/2003 | Huang et al. | |
| 2003/0063976 | A1* | 4/2003 | Horng | F04D 29/282 416/183 |

(Continued)

FOREIGN PATENT DOCUMENTS

| | | |
|---|---|---|
| JP | 4-285514 A | 10/1992 |
| JP | 4-287892 A | 10/1992 |

(Continued)

*Primary Examiner* — Justin D Seabe
*Assistant Examiner* — Jason G Davis
(74) *Attorney, Agent, or Firm* — Keating & Bennett

(57) ABSTRACT

A centrifugal fan includes a motor, a support body, a rotating body, and a housing. The motor includes a rotor hub that rotates around a central axis extending up and down. The support body is fixed to the rotor hub and rotates together with the rotor hub. The rotating body is different from the support body in material. The rotating body is a continuous porous body. The housing accommodates the rotating body, the support body, and the motor. The housing includes an air inlet open in an axial direction and at least one air outlet open in a radial direction. A radially inner surface of the rotating body opposes a radially outer surface of the rotor hub with a gap interposed therebetween.

15 Claims, 16 Drawing Sheets

(56) References Cited

U.S. PATENT DOCUMENTS

| | | | | |
|---|---|---|---|---|
| 2004/0184914 | A1 | 9/2004 | Doege et al. | |
| 2009/0160593 | A1 | 6/2009 | Koyatsu | |
| 2012/0195747 | A1 | 8/2012 | Fukuda et al. | |
| 2013/0286581 | A1 | 10/2013 | MacDonald | |
| 2016/0010655 | A1* | 1/2016 | Wu | F04D 17/167 417/354 |
| 2016/0036298 | A1 | 2/2016 | Yamamoto et al. | |
| 2019/0120238 | A1* | 4/2019 | Horng | F04D 25/0646 |

FOREIGN PATENT DOCUMENTS

| | | | | |
|---|---|---|---|---|
| JP | 4-287893 | A | 10/1992 | |
| JP | 4-287895 | A | 10/1992 | |
| JP | 4-295197 | A | 10/1992 | |
| JP | 4-295198 | A | 10/1992 | |
| JP | 4-353294 | A | 12/1992 | |
| JP | 5-26195 | A | 2/1993 | |
| JP | 5-33794 | A | 2/1993 | |
| JP | 5-39793 | A | 2/1993 | |
| JP | 5-39794 | A | 2/1993 | |
| JP | 5-39795 | A | 2/1993 | |
| JP | 5-39796 | A | 2/1993 | |
| JP | 5-202886 | A | 8/1993 | |
| JP | 5-296186 | A | 11/1993 | |
| JP | 5-302590 | A | 11/1993 | |
| JP | 6-93995 | A | 4/1994 | |
| JP | 7-49097 | A | 2/1995 | |
| JP | 7-125017 | A | 5/1995 | |
| JP | 7-35953 | U | 7/1995 | |
| JP | 7-310694 | A | 11/1995 | |
| JP | 7-310695 | A | 11/1995 | |
| JP | 7-329106 | A | 12/1995 | |
| JP | 8-151997 | A | 6/1996 | |
| JP | 8-166182 | A | 6/1996 | |
| JP | 9-126188 | A | 5/1997 | |
| JP | 2003-278687 | A | 10/2003 | |
| WO | WO-2010042077 | A1 * | 4/2010 | F04D 17/167 |

* cited by examiner

CENTRIFUGAL FAN

CROSS REFERENCE TO RELATED APPLICATIONS

This application claims the benefit of priority to Japanese Patent Application No. 2018-031906 filed on Feb. 26, 2018. The entire contents of this application are hereby incorporated herein by reference.

BACKGROUND OF THE INVENTION

1. Field of the Invention

The present disclosure relates to a centrifugal fan.

2. Description of the Related Art

General centrifugal fans rotate a plurality of blades to convert an incoming airflow parallel to the axial direction into a radial airflow and discharge the radial airflow. The centrifugal fan is mounted, for example, as a cooling fan, to an electronic device such as a notebook personal computer. The centrifugal fan to be mounted to the electronic device such as the notebook personal computer is required to have noise reduction.

In general centrifugal fans, however, turbulent flow which causes noise is generated in the vicinity of a radially distal end of each blade since the plurality of blades rotate. Specifically, the rotation of the plurality of blades generates a pressure difference in the circumferential direction between a front surface of each blade in the traveling direction and a rear surface in the traveling direction. As a result, an airflow flowing from the front surface in the traveling direction through the radially distal end of the blade toward the rear surface in the traveling direction is generated, and this airflow causes the turbulent flow.

SUMMARY OF THE INVENTION

A centrifugal fan according to an exemplary embodiment of the present disclosure includes a motor, a support body, a rotating body, and a housing. The motor includes a rotor hub that rotates around a central axis extending up and down. The support body is fixed to the rotor hub and rotates together with the rotor hub. The rotating body is different in material from the support body. The rotating body is a continuous porous body. The housing accommodates the rotating body, the support body, and the motor. The housing includes a first air inlet open in an axial direction and at least one air outlet open in a radial direction. A radially inner surface of the rotating body opposes a radially outer surface of the rotor hub with a gap interposed therebetween.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Figure 1A:
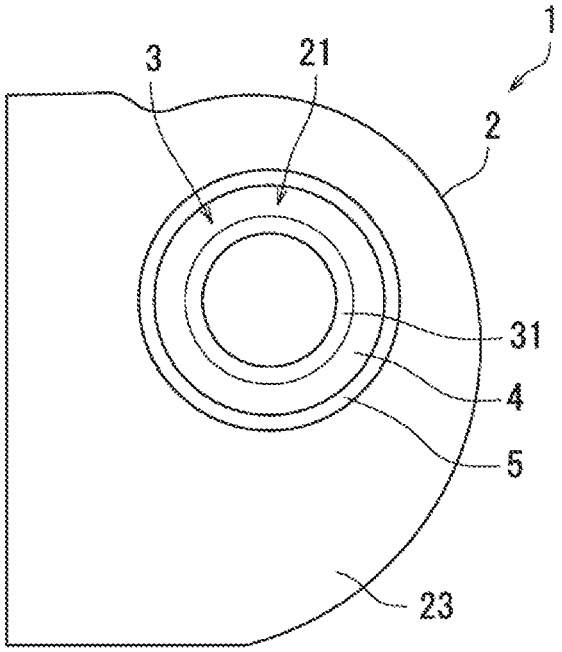
FIG. 1A is a plan view of a centrifugal fan according to a first exemplary embodiment of the present disclosure.

Hereinafter, exemplary embodiments of the present disclosure will be described with reference to the drawings. However, the present disclosure is not limited to the following embodiments. In the drawings, the same or corresponding parts will be denoted by the same reference signs, and descriptions thereof will not be repeated. Further, points for which descriptions overlap each other will be sometimes omitted as appropriate.

In the present specification, a direction in which a central axis AX (see FIG. 2) of a motor extends will be described as an up-down direction for the sake of convenience. However, the up-down direction is defined for convenience of the description, and there is no intention that the direction of the central axis AX coincides with the vertical direction. In the present specification, a direction parallel to the central axis AX of the motor will be referred to as an "axial direction", a radial direction and a circumferential direction around the central axis AX of the motor will be referred to as a "radial direction" and a "circumferential direction". However, in practicality, there is no intention to limit the orientation during use of the centrifugal fan according to the present disclosure to such definitions. Incidentally, the "parallel direction" includes a substantially parallel direction.

FIG. 1A is a plan view illustrating a centrifugal fan 1 according to a first embodiment. As illustrated in FIG. 1A, the centrifugal fan 1 includes a housing 2, a motor 3, a support body 4, and an annular rotating body 5.

The housing 2 has an air inlet 21 that is open in the axial direction. Specifically, the housing 2 has a cover member 23, and the cover member 23 has the air inlet 21. In the present embodiment, the cover member 23 forms an upper wall portion of the housing 2.

Figure 1B:
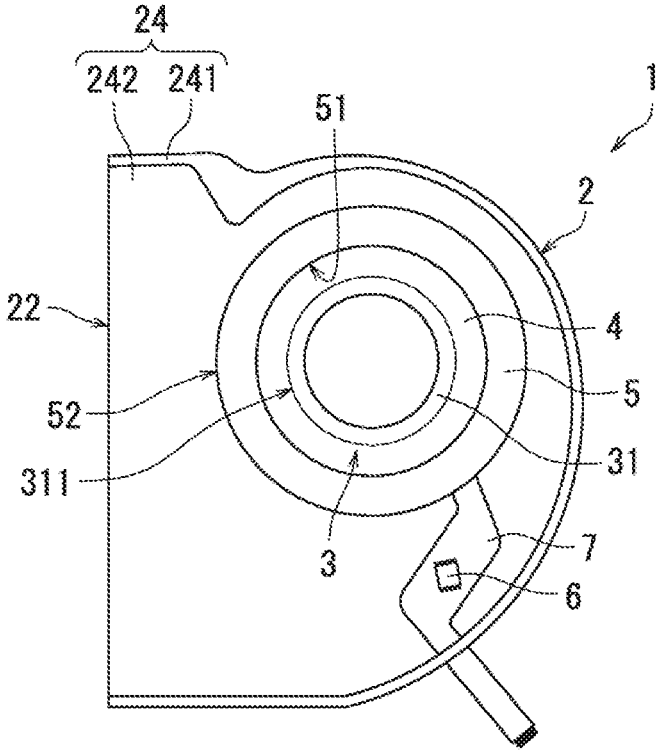
FIG. 1B is a plan view illustrating the inside of the centrifugal fan according to the first exemplary embodiment of the present disclosure.

FIG. 1B is a plan view illustrating the inside of the centrifugal fan 1 according to the first embodiment. Specifically, FIG. 1B illustrates the centrifugal fan 1 from which the cover member 23 illustrated in FIG. 1A has been removed. As illustrated in FIG. 1B, the housing 2 accommodates the motor 3, the support body 4, and the rotating body 5. Further, the housing 2 has an air outlet 22 that is open in the radial direction. Specifically, the housing 2 has a case member 24. The case member 24 is covered with the cover member 23 illustrated in FIG. 1A. The case member 24 has a side wall portion 241, and the side wall portion 241 has an air outlet 22. Further, the case member 24 has a lower wall portion 242. The lower wall portion 242 opposes the cover member 23 illustrated in FIG. 1A in the axial direction.

As illustrated in FIG. 1B, the centrifugal fan 1 further includes a motor driver 6 and a wiring board 7. The motor driver 6 generates a drive signal to d rive the motor 3 based on a control signal transmitted from an external controller. The motor driver 6 is mounted to the wiring board 7. The wiring board 7 receives the control signal transmitted from the external controller and transmits the received control signal to the motor driver 6. Further, the wiring board 7 transmits the drive signal generated by the motor driver 6 to the motor 3. The housing 2 further accommodates the motor driver 6. In the present embodiment, the housing 2 accommodates a part of the wiring board 7.

Figure 2:
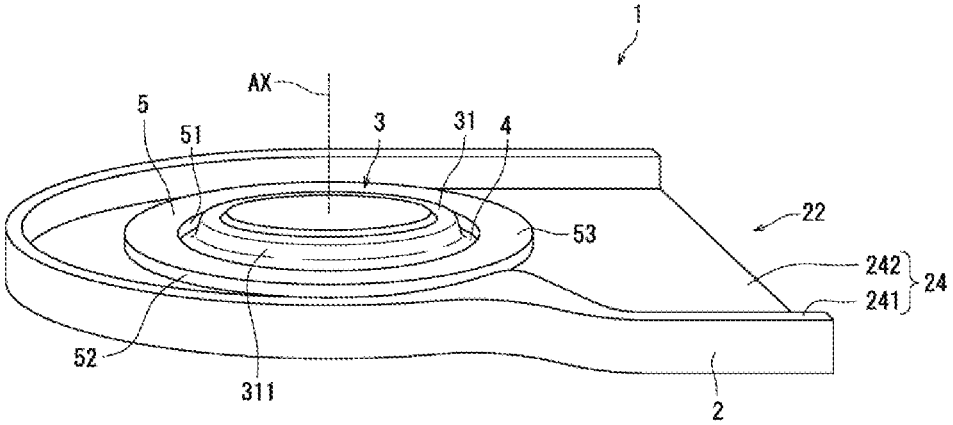
FIG. 2 is a perspective view illustrating the inside of the centrifugal fan according to the first exemplary embodiment of the present disclosure.

FIG. 2 is a perspective view illustrating the inside of the centrifugal fan 1 according to the first embodiment. Specifically, FIG. 2 illustrates the centrifugal fan 1 from which the cover member 23 illustrated in FIG. 1A has been removed. As illustrated in FIGS. 1A, 1B, and 2, the motor 3 has a rotor hub 31 that rotates about a central axis AX. The rotor hub 31 has a radially outer surface 311. The support body 4 is fixed to the rotor hub 31 and rotates together with the rotor hub 31. Specifically, the support body 4 protrudes in the radial direction from the rotor hub 31. The rotor hub 31 protrudes axially upward from a proximal end portion of the support body 4. Incidentally, the rotor hub 31 and the support body 4 may be integrated or may be separate bodies.

The rotating body 5 is fixed to the support body 4 and extends in the circumferential direction. The rotating body 5 has a radially inner surface 51 and a radially outer surface 52. The radially inner surface 51 of the rotating body 5 opposes the radially outer surface 311 of the rotor hub 31 in the radial direction with a gap interposed therebetween. The radially outer surface 52 of the rotating body 5 opposes the side wall portion 241 in the radial direction with a gap interposed therebetween. Further, the rotating body 5 has an axially upper surface 53. The axially upper surface 53 opposes the cover member 23 illustrated in FIG. 1A in the axial direction with a gap interposed therebetween. In other words, the axially upper surface 53 is the surface of the rotating body 5 on the air inlet 21 side.

A material of the rotating body 5 is different from a material of the support body 4. The material of the rotating body 5 is, for example, a continuous porous body such as foamed urethane. The continuous porous body is a material which has a plurality of continuous air holes such that a wall between adjacent air holes is open and through which a fluid such as a gas can pass. For example, the material of the rotating body 5 may be an open-cell structure. The open-cell structure is a material which has a plurality of continuous air cells (air holes) such that a wall between adjacent air cells is open and through which a fluid such as a gas can pass. The material of the support body 4 is, for example, hard plastic.

Next, an operation of the centrifugal fan 1 will be described with reference to FIGS. 1A, 1B, and 2. When the rotor hub 31 rotates in the centrifugal fan 1, the support body 4 and the rotating body 5 rotate in the circumferential direction about the central axis AX. When the rotating body 5 rotates in the circumferential direction, the air inside the rotating body 5 moves to the radially outer surface 52 of the rotating body 5 by a centrifugal force and is sent from the radially outer surface 52 of the rotating body 5 to the outside of the rotating body 5. The air sent from the radially outer surface 52 of the rotating body 5 to the outside of the rotating body 5 is sent to the outside of the housing 2 from the air outlet 22. On the other hand, when the air inside the rotating body 5 is sent to the outside of the rotating body 5, the air between the rotor hub 31 and the radially inner surface 51 of the rotating body 5 is sucked from the radially inner surface 51 of the rotating body 5 into the inside of the rotating body 5. As a result, the air outside the housing 2 is sucked into a space between the rotor hub 31 inside the housing 2 and the radially inner surface 51 of the rotating body 5 from the air inlet 21. Therefore, when the rotor hub 31 rotates, the air is sucked into the inside of the housing 2 from the air inlet 21, and the air sucked into the interior of the housing 2 is blown to the outside of the housing 2 from the air outlet 22.

When the rotating body 5 rotates in the circumferential direction, friction is generated between the axially upper surface 53 of the rotating body 5 and the air. As a result, the air existing in the gap between the axially upper surface 53 of the rotating body 5 and the cover member 23 moves to the radially outer surface 52 side of the rotating body 5. Therefore, airflow (reverse flow) flowing from the gap between the axially upper surface 53 of the rotating body 5 and the cover member 23 to the air inlet 21 hardly occurs. Accordingly, the efficiency of the centrifugal fan 1 can be improved.

The centrifugal fan 1 according to the first embodiment has been described above with reference to FIGS. 1A, 1B, and 2. According to the present embodiment, noise can be reduced by using the annular rotating body made of the continuous porous body. In other words, it is possible to achieve noise reduction. Specifically, in a centrifugal fan using a rotating body having a plurality of blades, turbulent flow that causes noise is generated due to a pressure difference generated in the vicinity of a radially distal end of each blade. According to the present embodiment, however, since the annular rotating body made of the continuous porous body is rotated, the turbulent flow is less likely to occur as compared with the centrifugal fan that rotates the plurality of blades. Therefore, the noise can be reduced.

According to the present embodiment, the radially inner surface 51 of the rotating body 5 opposes the radially outer surface 311 of the rotor hub 31 with the gap interposed therebetween. Therefore, air easily enters the inside of the rotating body 5 from the radially inner surface 51 of the rotating body 5, and it is possible to increase the amount of air blowing of the centrifugal fan 1.

According to the present embodiment, since the rotating body 5 is configured using the continuous porous body, it is possible to reduce a weight of the rotating body 5. Therefore, it is easy to take eccentric balance of the rotating body 5. For example, it is possible to achieve weight reduction of the rotating body 5 by using the open-cell structure as the material of the rotating body 5. Further, it is possible to rate the rotating body 5 at a high speed by achieving the weight reduction of the rotating body 5. Since the rotating body 5 is rotated at a high speed, it is possible to stably rotate the rotating body 5 even if a load fluctuates.

According to the present embodiment, the axially upper surface 53 of the rotating body 5 moves the air to the radially outer surface 52 side of the rotating body 5. Therefore, the amount of air blowing of the centrifugal fan 1 can be increased.

According to the present embodiment, the open-cell structure can be used as the material of the rotating body 5. Since the open-cell structure is a material which is easily processed, it is possible to easily manufacture the rotating body 5 by using the open-cell structure as the material of the rotating body 5.

Since the open-cell structure is used as the material of the rotating body 5, the rotating body 5 can be made soft. When the rotating body 5 is soft, the housing 2 is not easily damaged even if the rotating body 5 comes into contact with the housing 2. Therefore, it is possible to narrow the gap between the rotating body 5 and the housing 2 by using the open-cell structure as the material of the rotating body 5 according to the present embodiment. In other words, it is possible to achieve size reduction of the centrifugal fan 1.

Figure 3:
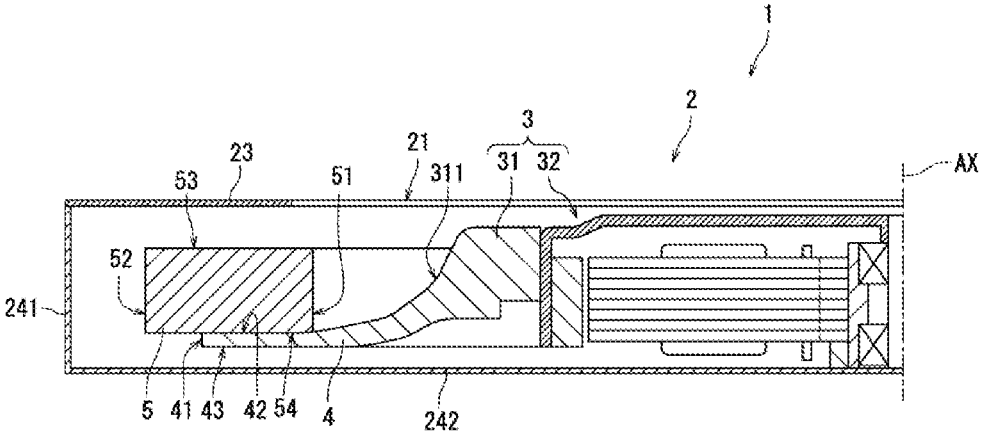
FIG. 3 is a cross-sectional view illustrating a portion of the centrifugal fan according to the first exemplary embodiment of the present disclosure.

Next, the centrifugal fan 1 according to the present embodiment will be described further with reference to FIG. 3. FIG. 3 is a cross-sectional view illustrating a part of the centrifugal fan 1 according to the first embodiment. Specifically, FIG. 3 illustrates cross sections of the housing 2, the motor 3, the support body 4 and the rotating body 5.

As illustrated in FIG. 3, the motor 3 has a motor unit 32. The motor unit 32 rotates the rotor hub 31 in the circumferential direction about the central axis AX.

The rotating body 5 has an axially lower surface 54. The axially lower surface 54 opposes the lower wall portion 242 in the axial direction. In other words, the axially lower surface 54 is the surface of the rotating body 5 on the support body 4 side. The support body 4 has a radially outer surface 41. The radially outer surface 41 is an outer-diameter-side distal end surface of the support body 4. Further, the support body 4 has an axially upper surface 42 and an axially lower surface 43. The axially upper surface 42 opposes the cover member 23 in the axial direction. The axially lower surface 43 opposes the lower wall portion 242 in the axial direction with a gap interposed therebetween. The rotating body 5 is arranged on the axially upper surface 42 of the support body 4.

In the present embodiment, an outer diameter of the rotating body 5 is larger than an opening diameter of the air inlet 21. The outer diameter of the rotating body 5 indicates a distance from the central axis AX to the radially outer surface 52 of the rotating body 5. The opening diameter of the air inlet 21 indicates a distance from the central axis AX to an edge of the air inlet 21. At least a part of the rotating body 5 is covered with the cover member 23 since the outer diameter of the rotating body 5 is larger than the opening diameter of the air inlet 21. With this configuration, the airflow (reverse flow) flowing from the radially outer surface 52 side of the rotating body 5 to the air inlet 21 side hardly occurs. In the present embodiment, an inner diameter of the rotating body 5 is smaller than the opening diameter of the air inlet 21 so that a part of the rotating body 5 is covered with the cover member 23. The inner diameter of the rotating body 5 indicates a distance from the central axis AX to the radially inner surface 51 of the rotating body 5.

In the present embodiment, the outer diameter of the rotating body 5 is larger than an outer diameter of the support body 4. The outer diameter of the support body 4 indicates a distance from the central axis AX to the radially outer surface 41 of the support body 4. Since the outer diameter of the rotating body 5 is larger than the outer diameter of the support body 4, the volume of the rotating body 5 can be increased as compared with the case where the outer diameter of the rotating body 5 is equal to or smaller than the outer diameter of the support body 4. Therefore, it is possible to increase the amount of air blowing. Further, it is possible to reduce the outer diameter of the support body 4 which is heavier than the rotating body 5. Therefore, it is possible to reduce inertia.

In the present embodiment, the radially inner surface 51 of the rotating body 5 is parallel to the central axis AX. When the radially inner surface 51 of the rotating body 5 is parallel to the central axis AX, the radially inner surface 51 of the rotating body 5 becomes linear from the axially upper surface 53 to the axially lower surface 43. Therefore, the manufacturing of the rotating body 5 becomes easy.

In the present embodiment, the radially outer surface 52 of the rotating body 5 is parallel to the central axis AX. When the radially outer surface 52 of the rotating body 5 is parallel to the central axis AX, the radially outer surface 52 of the rotating body 5 becomes linear from the axially upper surface 53 to the axially lower surface 43. Therefore, the manufacturing of the rotating body 5 becomes easy.

Incidentally, it is preferable that the axially upper surface 53 of the rotating body 5 be hard. Since the axially upper surface 53 of the rotating body 5 is hard, a shape of the rotating body 5 during the rotation is stabilized. In other words, the rotating body 5 is hardly deformed during the rotation. Further, even when the rotating body 5 and the cover member 23 come into contact with each other, the rotating body 5 is hardly worn. Therefore, it is possible to achieve size reduction of the centrifugal fan 1 by narrowing the gap between the rotating body 5 and the cover member 23. For example, when the material of the rotating body 5 is an open-cell structure, it is possible to make the axially upper surface 53 of the rotating body 5 hard using heat, a chemical liquid, or the like.

Alternatively, the rotating body 5 may have a base member made of a continuous porous body and a sheet member pasted to the axially upper surface of the base member. In other words, the axially upper surface 53 of the rotating body 5 may be formed of the sheet member. Since the axially upper surface 53 of the rotating body 5 is formed of the sheet member, the shape of the rotating body 5 during the rotation is stabilized. Further, even when the rotating body 5 and the cover member 23 come into contact with each other, the rotating body 5 is hardly worn.

It is preferable that the axially lower surface 54 of the rotating body 5 be hard. Since the axially lower surface 54 of the rotating body 5 is hard, the shape of the rotating body 5 during the rotation is stabilized. Further, the rotating body 5 can be easily fixed to the support body 4. For example, when the material of the rotating body 5 is an open-cell structure, it is possible to make the axially lower surface 54 of the rotating body 5 hard using heat, a chemical liquid, or the like.

Alternatively, the rotating body 5 may have a base member made of a continuous porous body and a sheet member pasted to the axially lower surface of the base member. In other words, the axially lower surface 54 of the rotating body 5 may be formed of the sheet member. Since the axially lower surface 54 of the rotating body 5 is formed of the sheet member, the shape of the rotating body 5 during the rotation is stabilized. Further, the rotating body 5 can be easily fixed to the support body 4.

Figure 4A:
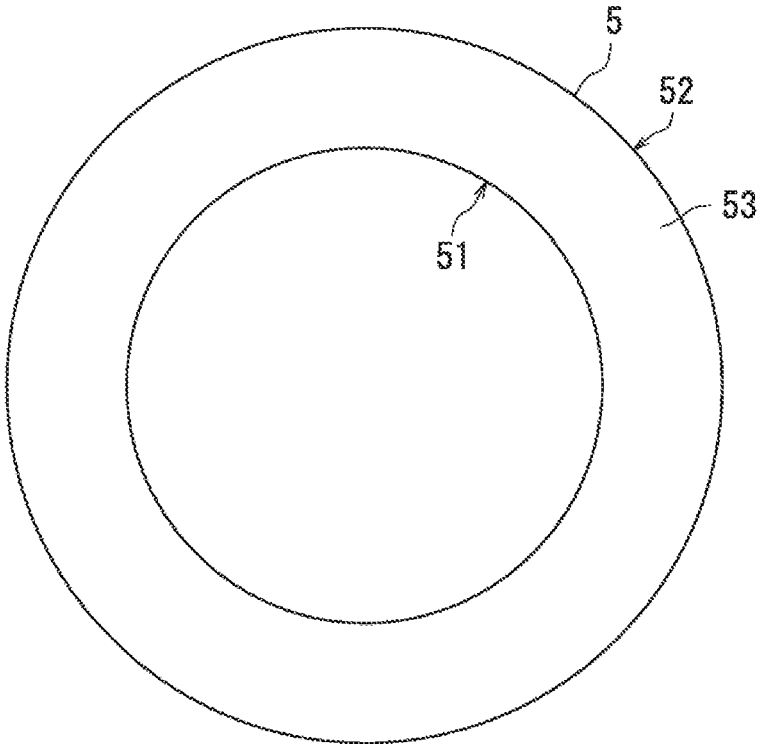
FIG. 4A is a plan view illustrating a rotating body according to the first exemplary embodiment of the present disclosure.

Next, the rotating body 5 will be further described with reference to FIGS. 4A and 4B. FIG. 4A is a plan view illustrating the rotating body 5. As illustrated in FIG. 4A, a width of the rotating body 5 in the radial direction is constant in the present embodiment. When the width of the rotating body 5 in the radial direction is constant, a curvature of the radially inner surface 51 of the rotating body 5 becomes constant, and a curvature of the radially outer surface 52 of the rotating body 5 becomes constant. Therefore, the manufacturing of the rotating body 5 becomes easy. Incidentally, it is preferable that the inner diameter of the rotating body 5 be three-quarters of the outer diameter of the rotating body 5 or larger. Since the inner diameter of the rotating body 5 is set to three-quarters of the outer diameter of the rotating body 5 or larger, the inner diameter of the rotating body 5 can be increased. When the inner diameter of the rotating body 5 is increased, air is likely to enter the inside of the rotating body 5 from the radially inner surface 51 of the rotating body 5 so that the air can be efficiently moved to the radially outer surface 52 side of the rotating body 5.

Figure 4B:
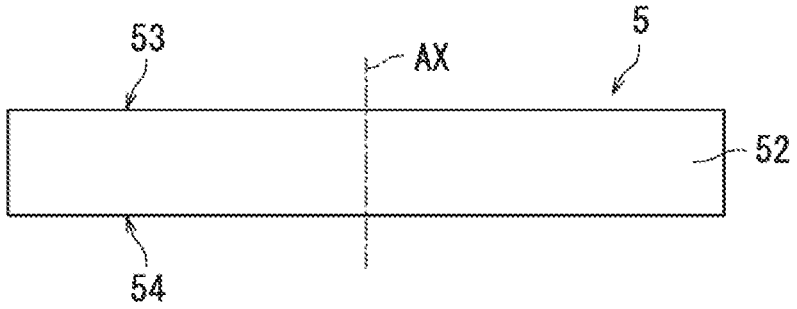
FIG. 4B is a side view illustrating the rotating body according to the first exemplary embodiment of the present disclosure.

FIG. 4B is a side view illustrating the rotating body 5. As illustrated in FIG. 4B, a thickness of the rotating body 5 in the axial direction is constant in the present embodiment. When the thickness of the rotating body 5 in the axial direction is constant, for example, the rotating body 5 can be manufactured by cutting a sheet-like material. Therefore, the manufacturing of the rotating body 5 becomes easy. As the thickness of the rotating body 5 in the axial direction increases, the gap (see FIG. 3) between the axially upper surface 53 and the cover member 23 becomes narrower, and airflow (reverse flow) flowing from the gap to the air inlet 21 hardly occurs. Accordingly, the efficiency of the centrifugal fan 1 can be improved.

The first embodiment has been described above with reference to FIGS. 1A to 4B. In the present embodiment, it is unnecessary to clearly define a boundary between the rotor hub 31 and the support body 4 as long as the rotor hub 31 has the radially outer surface 311 and the support body 4 has the axially upper surface 42 and the axially lower surface 43. Although the cover member 23 has the air inlet 21 in the present embodiment, the lower wall portion 242 may have the air inlet 21. When the lower wall portion 242 has the air inlet 21, the rotor hub 31 may protrude downward in the axial direction, and the rotating body 5 may be arranged on the axially lower surface 43 of the support body 4.

Figure 5:
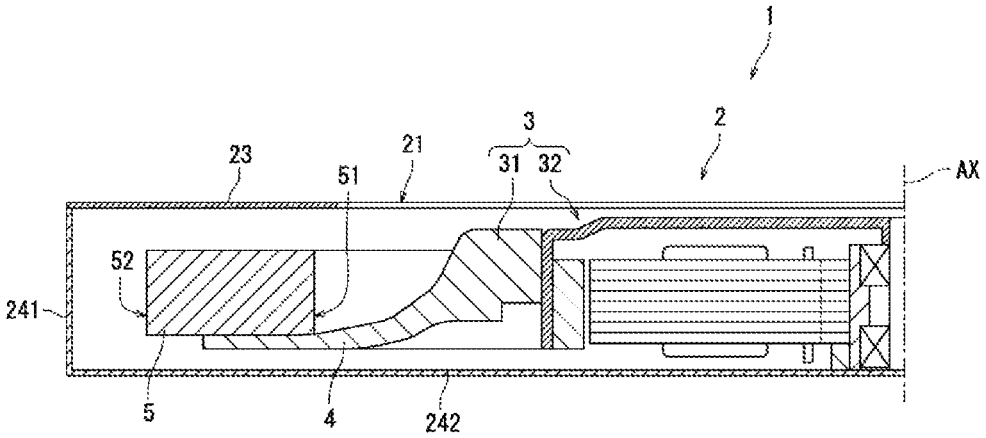
FIG. 5 is a view illustrating a modified example of the centrifugal fan according to the first exemplary embodiment of the present disclosure.

Although the case where the inner diameter of the rotating body 5 is smaller than the opening diameter of the air inlet 21 has been described in the present embodiment, the inner diameter of the rotating body 5 may be larger than the opening diameter of the air inlet 21 as illustrated in FIG. 5. FIG. 5 is a view illustrating a modified example of the centrifugal fan 1 according to the first embodiment. Specifically, FIG. 5 illustrates cross sections of the housing 2, the motor 3, the support body 4, and the rotating body 5 according to the modified example.

As illustrated in FIG. 5, the inner diameter of the rotating body 5 is larger than the opening diameter of the air inlet 21 so that the air sucked from the air inlet 21 easily reaches the radially inner surface 51 of the rotating body 5. As a result, the amount of air sucked into the inside of the rotating body 5 from the radially inner surface 51 of the rotating body 5 increases. Therefore, it is possible to increase the amount of air blowing. Since the inner diameter of the rotating body 5 is larger than the opening diameter of the air inlet 21, it is difficult for foreign substances to come into contact with the rotating body 5 via the air inlet 21. Therefore, the rotating body 5 is hardly damaged.

The inner diameter of the rotating body 5 may be the same as the opening diameter of the air inlet 21. Since the inner diameter of the rotating body 5 is the same as the opening diameter of the air inlet 21, the air sucked from the air inlet 21 easily reaches the radially inner surface 51 of the rotating body 5 as compared with the case where the inner diameter of the rotating body 5 is smaller than the opening diameter of the air inlet 21. As a result, the amount of air sucked into the inside of the rotating body 5 from the radially inner surface 51 of the rotating body 5 increases. Therefore, it is possible to increase the amount of air blowing. Since the inner diameter of the rotating body 5 is the same as the opening diameter of the air inlet 21, it is difficult for foreign substances to come into contact with the rotating body 5 via the air inlet 21 as compared with the case where the inner diameter of the rotating body 5 is smaller than the opening diameter of the air inlet 21. Therefore, the rotating body 5 is hardly damaged.

Next, a second embodiment of the present disclosure will be described with reference to FIGS. 6A to 7. However, items different from those of the first embodiment will be described, and descriptions for the same items as those of the first embodiment will be omitted. The second embodiment is different from the first embodiment in terms of a configuration of the support body 4.

Figure 6A:
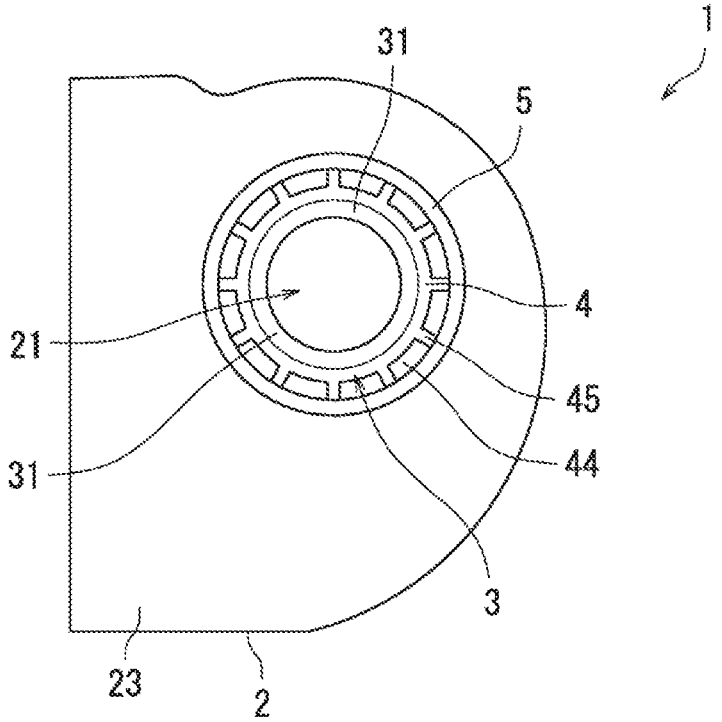
FIG. 6A is a plan view of a centrifugal fan according to a second exemplary embodiment of the present disclosure.
Figure 6B:
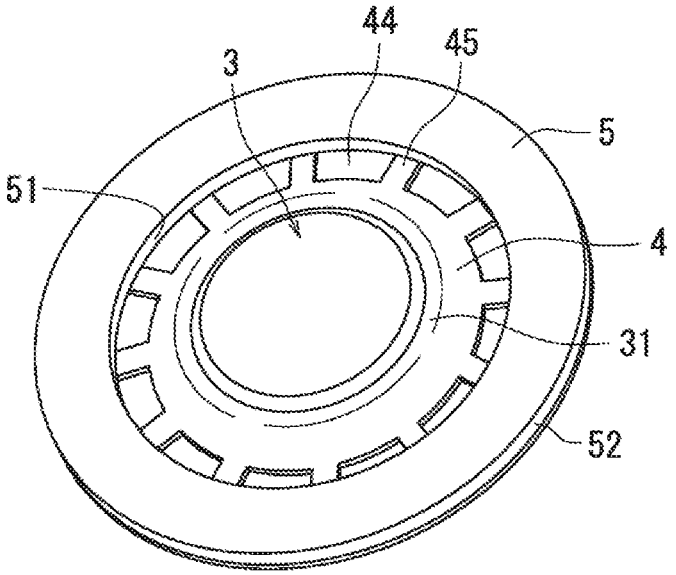
FIG. 6B is a perspective view illustrating a motor, a support body, and a rotating body according to the second exemplary embodiment of the present disclosure.

FIG. 6A is a plan view illustrating the centrifugal fan 1 according to the second embodiment. FIG. 6B is a perspective view illustrating the motor 3, the support body 4, and the rotating body 5 according to the second embodiment. As illustrated in FIGS. 6A and 6B, the support body 4 according to the second embodiment has a plurality of through-holes 44. Each of the through-holes 44 passes through the support body 4 in the axial direction. In the present embodiment, the plurality of through-holes 44 is arranged in the circumferential direction. Further, the support body 4 according to the second embodiment has a rib portion 45 positioned between the adjacent through-holes 44.

Figure 7:
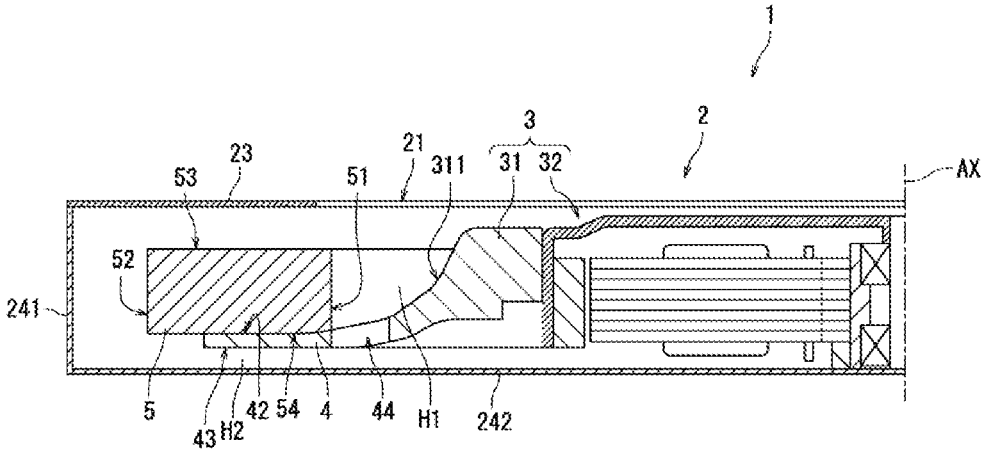
FIG. 7 is a cross-sectional view illustrating a portion of the centrifugal fan according to the second exemplary embodiment of the present disclosure.

FIG. 7 is a cross-sectional view illustrating a part of the centrifugal fan 1 according to the second embodiment. Specifically, FIG. 7 illustrates cross sections of the housing 2, the motor 3, the support body 4, and the rotating body 5. As illustrated in FIG. 7, each of the through-holes 44 is arranged to be open in a gap H1 between the radially inner surface 51 of the rotating body 5 and the radially outer surface 311 of the rotor hub 31.

The second embodiment has been described above with reference to FIGS. 6A to 7. According to the second embodiment, it is possible to reduce the weight of the support body 4. Therefore, it is possible to reduce the weight of the centrifugal fan 1. Further, it is possible to send air from the through-hole 44 to a gap H2 (see FIG. 7) between the support body 4 and the lower wall portion 242 by the rib portion 45 of the support body 4. Therefore, airflow (reverse flow) flowing from the gap H2 to the through-hole 44 hardly occurs, so that it is possible to suppress the occurrence of turbulent flow. As a result, noise can be reduced.

In the present embodiment, it is unnecessary to clearly define a boundary between the rotor hub 31 and the support body 4 as long as the rotor hub 31 has the radially outer surface 311 and the support body 4 has the axially upper surface 42, the axially lower surface 43, and the plurality of through-holes 44.

In the present embodiment, the case where each of the through-holes 44 is open in the gap between the radially inner surface 51 of the rotating body 5 and the radially outer surface 311 of the rotor hub 31 has been described. However, a part of each of the through-holes 44 may be arranged to be open in the gap between the radially inner surface 51 of the rotating body 5 and the radially outer surface 311 of the rotor hub 31. In other words, a part of each of the through-holes 44 may be covered with the rotating body 5. Alternatively, each of the through-holes 44 may be completely covered with the rotating body 5. Alternatively, the plurality of through-holes 44 may include a through-hole 44 that is completely open in the gap between the radially inner surface 51 of the rotating body 5 and the radially outer surface 311 of the rotor hub 31, a through-hole 44 partially covered with the rotating body 5, and a through-hole 44 entirely covered with the rotating body 5.

Although the cover member 23 has the air inlet 21 in the present embodiment, the lower wall portion 242 may have the air inlet 21. When the lower wall portion 242 has the air inlet 21, the air sucked from the air inlet 21 of the lower wall portion 242 passes through the through-hole 44 of the support body 4 and is sucked into the rotating body 5. Alternatively, when the lower wall portion 242 has the air inlet 21, the rotor hub 31 may protrude downward in the axial direction and the rotating body 5 may be arranged on the axially lower surface 43 of the support body 4 as described in the first embodiment.

Next, a third embodiment of the present disclosure will be described with reference to FIGS. 8A to 10B. However, items different from those of the first and second embodiments will be described, and descriptions for the same items as those of the first and second embodiments will be omitted. The third embodiment is different from the first and second embodiments in terms of a configuration of the housing 2.

Figure 8A:
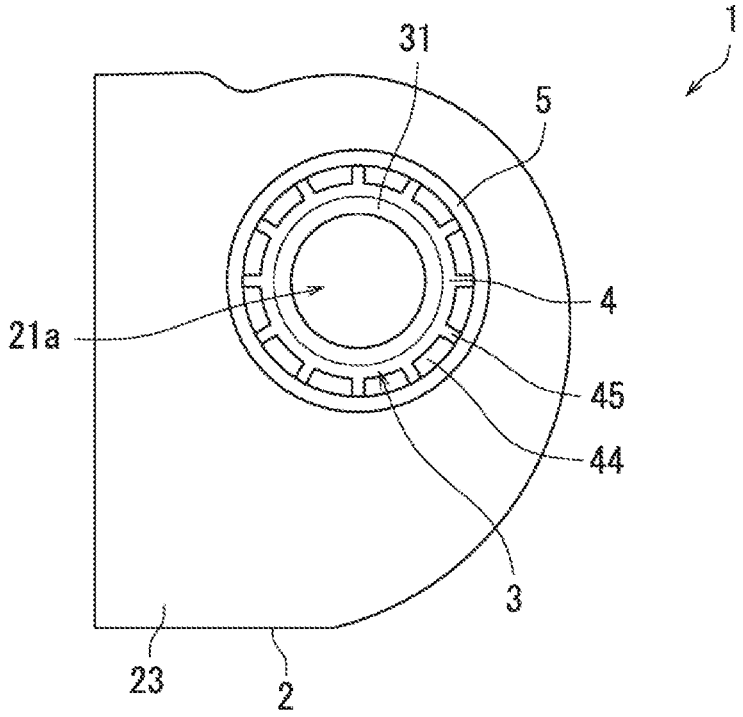
FIG. 8A is a plan view of a centrifugal fan according to a third exemplary embodiment of the present disclosure.
Figure 8B:
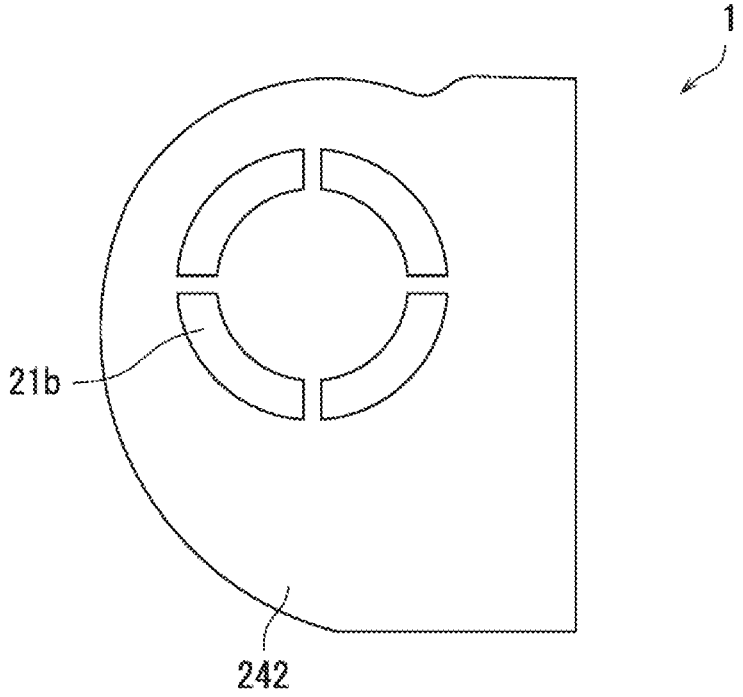
FIG. 8B is a bottom view of the centrifugal fan according to the third exemplary embodiment of the present disclosure.

FIG. 8A is a plan view illustrating the centrifugal fan 1 according to the third embodiment. FIG. 8B is a bottom view illustrating the centrifugal fan 1 according to the third embodiment. As illustrated in FIGS. 8A and 8B, the housing 2 according to the third embodiment has a first air inlet 21*a* and a second air inlet 21*b*. Specifically, the cover member 23 has the first air inlet 21*a* open in the axial direction, and the lower wall portion 242 has the second air inlet 21*b* open in the axial direction.

Figure 9:
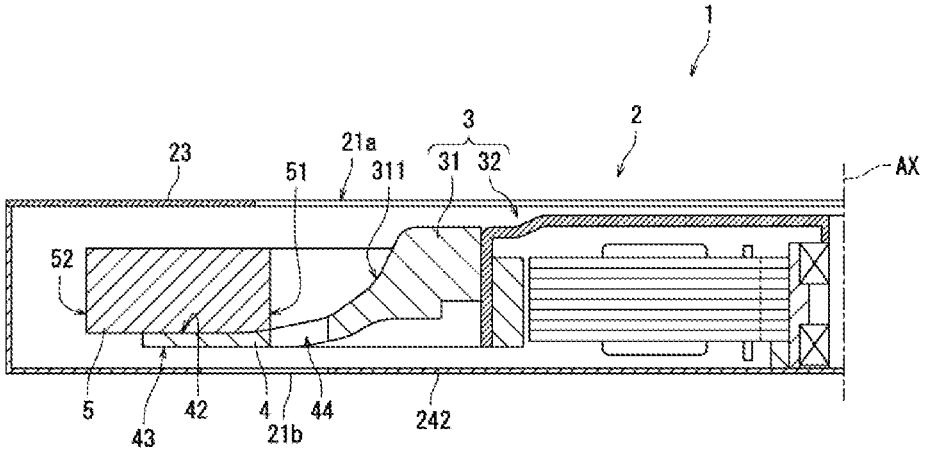
FIG. 9 is a cross-sectional view of the centrifugal fan according to the third exemplary embodiment of the present disclosure.

FIG. 9 is a cross-sectional view illustrating a part of the centrifugal fan 1 according to the third embodiment. Specifically, FIG. 9 illustrates cross sections of the housing 2, the motor 3, the support body 4, and the rotating body 5. As illustrated in FIG. 9, the rotating body 5 is arranged on the axially upper surface 42 of the support body 4, and at least a part of each of the through-holes 44 is arranged to be open in a gap between the radially inner surface 51 of the rotating body 5 and the radially outer surface 311 of the rotor hub 31.

The centrifugal fan 1 according to the third embodiment has been described above with reference to FIGS. 8A to 9. According to the third embodiment, air is sucked into the inside of the housing 2 from each of the first air inlet 21*a* and the second air inlet 21*b* as the rotating body 5 rotates. The air sucked from the first air inlet 21*a* is sucked into the rotating body 5 as described in the first embodiment. The air sucked from the second air inlet 21*b* passes through each of the through-holes 44 to be sucked into the rotating body 5. Therefore, it is possible to increase the amount of air blowing according to the third embodiment.

Figure 10A:
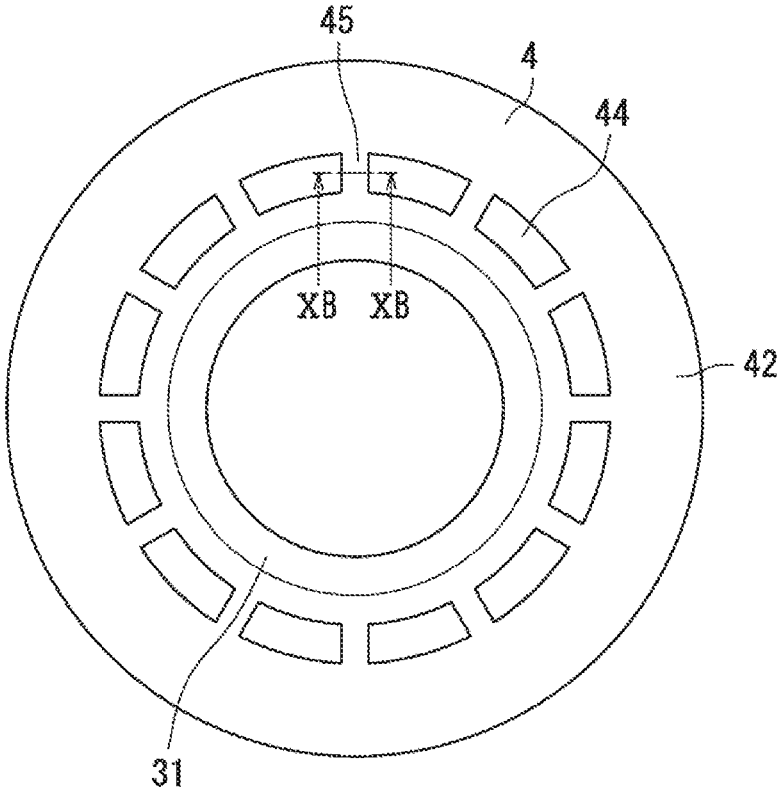
FIG. 10A is a plan view illustrating a rotor hub and a support body according to the third exemplary embodiment of the present disclosure.
Figure 10B:
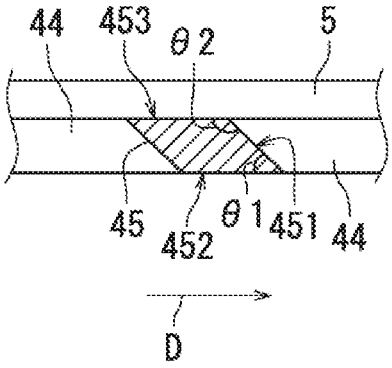
FIG. 10B is a view illustrating a cross section of a rib portion according to the third exemplary embodiment of the present disclosure.

Next, the support body 4 according to the third embodiment will be further described with reference to FIGS. 10A and 10B. FIG. 10A is a plan view illustrating the rotor hub 31 and the support body 4 according to the third embodiment. FIG. 10B is a view illustrating a cross section of the rib portion 45 according to the third embodiment. Specifically, FIG. 10B illustrates a cross section taken along the line XB-XB illustrated in FIG. 10A. In other words, FIG. 10B illustrates a cross section of the rib portion 45 as viewed from the radial direction. Incidentally, FIG. 10B also illustrates the rotating body 5 in order to facilitate understanding.

The rib portion 45 according to the third embodiment sends air from the lower side of the through-hole 44 to the upper side of the through-hole 44 during the rotation of the support body 4 and the rotating body 5. Therefore, the air sucked from the second air inlet 21*b* can be efficiently moved toward the rotating body 5.

Specifically, the rib portion 45 according to the third embodiment has a traveling-direction front surface 451, an axially lower surface 452, and an axially upper surface 453 as illustrated in FIG. 10B. The traveling-direction front surface 451 is a front surface of the support body 4 in a traveling direction D. The axially lower surface 452 opposes the lower wall portion 242 (FIG. 9) in the axial direction. The axially upper surface 453 opposes the cover member 23 (FIG. 9) in the axial direction. An angle 61 between the traveling-direction front surface 451 and the axially lower surface 452 is an acute angle, and an angle 62 between the traveling-direction front surface 451 and the axially upper surface 453 is an obtuse angle. Since the rib portion 45 has such a sectional shape, air can be sent from the lower side of the through-hole 44 to the upper side of the through-hole 44.

The third embodiment has been described above with reference to FIGS. 8A to 10B. Although the rotating body 5 is arranged on the axially upper surface 42 of the support body 4 in the present embodiment, the rotating body 5 may be arranged on the axially lower surface 43 of the support body 4. In this case, the rotor hub 31 protrudes downward in the axial direction.

Next, a fourth embodiment of the present disclosure will be described with reference to FIG. 11. However, items different from those of the first to third embodiments will be described, and descriptions for the same items as those of the first to third embodiments will be omitted. The fourth embodiment is different from the first to third embodiments in terms of a configuration of the rotating body 5.

Figure 11:
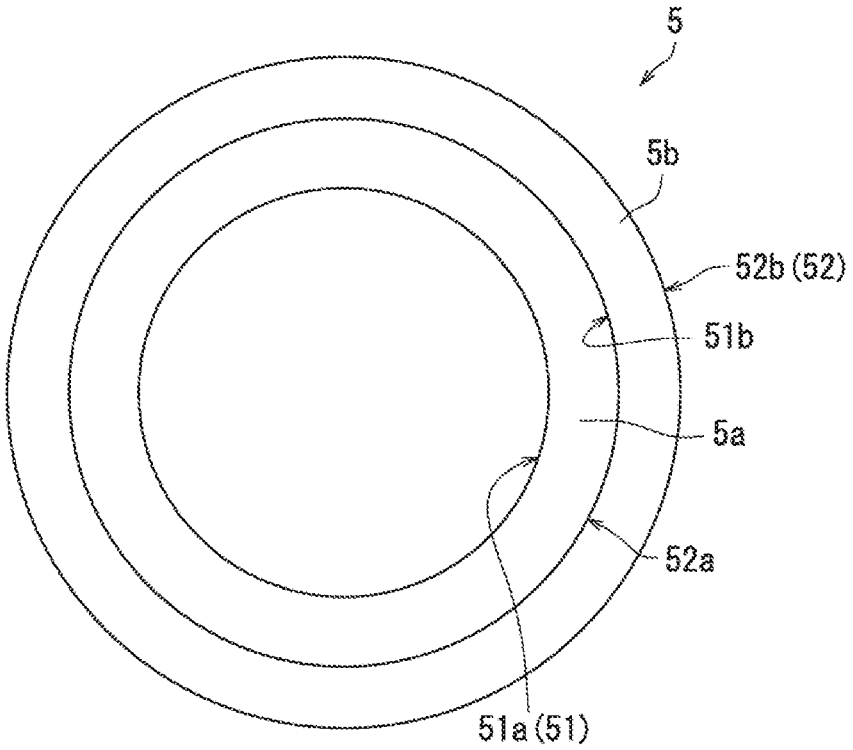
FIG. 11 is a plan view illustrating a rotating body according to a fourth exemplary embodiment of the present disclosure.

FIG. 11 is a plan view illustrating the rotating body 5 according to the fourth embodiment. An average pore diameter of the rotating body 5 (continuous porous body) according to the fourth embodiment differs between the radially inner surface 51 side and the radially outer surface 52 side. Specifically, the rotating body 5 according to the fourth embodiment has an annular first rotating body 5*a* and an annular second rotating body 5*b*, and an average pore diameter of the first rotating body 5*a* (continuous porous body) is different from an average pore diameter of the second rotating body 5*b* (continuous porous body) as illustrated in FIG. 11. Both the first rotating body 5*a* and the second rotating body 5*b* extend in the circumferential direction, and the first rotating body 5*a* is arranged inside the second rotating body 5*b*. Specifically, the radially outer surface 52*a* of the first rotating body 5*a* comes into contact with the radially inner surface 51*b* of the second rotating body 5*b*. The radially inner surface 51*a* of the first rotating body 5*a* forms the radially inner surface 51 of the rotating body 5, and the radially outer surface 52*b* of the second rotating body 5*b* forms the radially outer surface 52 of the rotating body 5.

According to the present embodiment, it is possible to increase the average pore diameter on the radially inner surface 51 side (the first rotating body 5*a*) of the rotating body 5 having a small centrifugal force. As a result, an air resistance of the radially inner surface 51 side (the first rotating body 5*a*) of the rotating body 5 decreases so that it becomes easy for air to entire the inside of the rotating body 5.

According to the present embodiment, the average pore diameter on the radially inner surface 51 side of the rotating body 5 is larger than the average pore diameter on the radially outer surface 52 side of the rotating body 5. Therefore, it is possible to catch a large foreign substance on the radially inner surface 51 side (the first rotating body 5*a*) of the rotating body 5 and catch a small foreign substance on the radially outer surface side (the second rotating body 5*b*) of the rotating body 5. Therefore, it is possible to suppress clogging of the rotating body 5 (filter).

The fourth embodiment has been described above with reference to FIG. 11. Although the rotating body 5 has the two rotating bodies (the first rotating body 5*a* and the second rotating body 5*b*) having different diameters in the present embodiment, the rotating body 5 may have three or more rotating bodies having different diameters. In this case, for example, a material having a smaller average pore diameter may be used in a portion closer to the radially outer surface 52 of the rotating body 5 as a material of each rotating body. Further, the case where the average pore diameter of the first rotating body 5*a* is larger than the average pore diameter of the second rotating body 5*b* has been described in the present embodiment, the average pore diameter of the first rotating body 5*a* may be smaller than the average pore diameter of the second rotating body 5*b*.

The embodiments of the present disclosure have been described above with reference to the drawings. However, the present disclosure is not limited to the above-described embodiments, and can be implemented in various modes without departing from a gist thereof.

For example, the housing 2 has the single air outlet 22 in the embodiments according to the present disclosure, but the housing 2 may have a plurality of the air outlets 22.

Although the case where the outer diameter of the rotating body 5 is larger than the opening diameter of the air inlet 21 has been described in the embodiments according to the present disclosure, the outer diameter of the rotating body 5 may be equal to or smaller than the opening diameter of the air inlet 21.

Although the case where the outer diameter of the rotating body 5 is larger than the outer diameter of the support body 4 has been described in the embodiments according to the present disclosure, the outer diameter of the rotating body 5 may be equal to or smaller than the outer diameter of the support body 4.

Although the case where the axially upper surface 53 and the axially lower surface 54 of the rotating body 5 are hard has been described in the embodiments according to the present disclosure, one of the axially upper surface 53 and the axially lower surface 54 of the rotating body 5 may be hard. Since one of the axially upper surface 53 and the axially lower surface 54 of the rotating body 5 is hard, the shape of the rotating body 5 during the rotation is stabilized. Alternatively, one of the axially upper surface 53 and the axially lower surface 54 of the rotating body 5 may be formed of a sheet member. Since one of the axially upper surface 53 and the axially lower surface 54 of the rotating body 5 is formed of the sheet member, the shape of the rotating body 5 during the rotation is stabilized.

Although the case where the axially upper surface 53 and the axially lower surface 54 of the rotating body 5 are hard has been described in the embodiments according to the present disclosure, the entire surface of the rotating body 5 may be hard. Since the entire surface of the rotating body 5 is hard, the rotating body 5 is hardly worn even when the rotating body 5 and the housing 2 come into contact with each other. Accordingly, it is possible to achieve size reduction of the centrifugal fan 1 by narrowing the gap between the rotating body 5 and the housing 2. Alternatively, the entire surface of the rotating body 5 may be formed of a sheet member having a large number of holes, or a net-like sheet member. Since the entire surface of the rotating body 5 is formed of the sheet member, the rotating body 5 is hardly worn even when the rotating body 5 and the housing 2 come into contact with each other. Accordingly, it is possible to achieve size reduction of the centrifugal fan 1 by narrowing the gap between the rotating body 5 and the housing 2.

The present disclosure is suitably applicable to, for example, a centrifugal fan.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A centrifugal fan comprising:

a motor including a rotor hub rotatable about a central axis extending up and down;

a support body fixed to the rotor hub and rotatable together with the rotor hub;

a rotating body made of a material different from a material of the support body and defined by a continuous porous body; and a housing to house the rotating body, the support body, and the motor; wherein the housing includes a first air inlet open in an axial direction and at least one air outlet open in a radial direction;

a radially inner surface of the rotating body opposes a radially outer surface of the rotor hub with a gap interposed therebetween; and an average pore diameter of the rotating body differs between a side of the radially inner surface of the rotating body and a side of a radially outer surface of the rotating body.

2. The centrifugal fan according to claim 1, wherein an outer diameter of the rotating body is larger than an outer diameter of the support body.

3. The centrifugal fan according to claim 1, wherein an inner diameter of the rotating body is three-quarters of an outer diameter of the rotating body or larger.

4. The centrifugal fan according to claim 1, wherein the support body includes a plurality of through-holes penetrating in the axial direction and a rib portion positioned between the through-holes adjacent to each other; and at least one of the plurality of through-holes includes at least a portion open in the gap between the radially inner surface of the rotating body and the radially outer surface of the rotor hub.

5. The centrifugal fan according to claim 4, wherein the housing includes an upper wall portion and a lower wall portion opposing each other in the axial direction;

the upper wall portion includes the first air inlet; and the lower wall portion includes a second air inlet that is open in the axial direction.

6. The centrifugal fan according to claim 5, wherein the rotating body is located on a surface of the support body opposing the upper wall portion in the axial direction.

7. The centrifugal fan according to claim 1, wherein an inner diameter of the rotating body is larger than an opening diameter of the first air inlet.

8. The centrifugal fan according to claim 1, wherein a surface of the rotating body on a side of the first air inlet is hardened by heat or a chemical liquid.

9. The centrifugal fan according to claim 1, wherein a surface of the rotating body on a side of the support body is hardened by heat or a chemical liquid.

10. The centrifugal fan according to claim 1, wherein the radially inner surface of the rotating body is parallel or substantially parallel to the central axis.

11. The centrifugal fan according to claim 1, wherein a radially outer surface of the rotating body is parallel or substantially parallel to the central axis.

12. The centrifugal fan according to claim 1, wherein a width of the rotating body in the radial direction is constant.

13. The centrifugal fan according to claim 1, wherein a thickness of the rotating body in the axial direction is constant.

14. The centrifugal fan according to claim 1, wherein the average pore diameter on the side of the radially inner surface of the rotating body is larger than the average pore diameter on the side of the radially outer surface of the rotating body.

15. The centrifugal fan according to claim 1, wherein a material of the rotating body includes an open-cell structure.

* * * * *